US006030496A

United States Patent [19]

Baggot et al.

[11] Patent Number: 6,030,496

[45] Date of Patent: Feb. 29, 2000

[54] MAKING A WEB

[75] Inventors: James Leo Baggot, Menasha; Michael Earl Daniels; David Robert Gruber, both of Neenah; Paul Kerner Pauling, Appleton; James D. Ba Dour, Jr., Green Bay; Larry E. Birnbaum, Green Bay; Rudolph S. Fortuna, Green Bay, all of Wis.

[73] Assignee: Kimberly-Clark Worldwide, Inc., Neenah, Wis.

[21] Appl. No.: 08/845,098

[22] Filed: Apr. 16, 1997

[51] Int. Cl.[7] ..... B31C 11/00; D21F 5/00

[52] U.S. Cl. ..... 162/111; 162/118; 162/120; 162/283; 242/540; 242/548; 242/551; 242/554; 242/555.1; 242/555.7; 242/559; 242/564

[58] Field of Search ..... 242/551, 554, 242/555.1, 555.7, 548, 559, 540, 564; 162/118, 120, 283, 111, 286

[56] References Cited

U.S. PATENT DOCUMENTS

| | | | |
|---|---|---|---|
| 2,617,606 | 11/1952 | Whatmore | 242/56 |
| 4,735,372 | 4/1988 | Seki | 242/58 |
| 4,944,470 | 7/1990 | Mobley | 242/58.4 |
| 4,969,588 | 11/1990 | Baker | 226/91 |
| 5,289,984 | 3/1994 | Somha | 242/58.3 |
| 5,709,354 | 1/1998 | Blandin et al. | 242/551 |
| 5,772,845 | 6/1998 | Farrington, Jr. et al. | 162/109 |

*Primary Examiner*—Peter Chin
*Attorney, Agent, or Firm*—Thomas J. Connelly; Douglas G. Glantz

[57] ABSTRACT

A method of making a tissue web is disclosed for forming a wet web, drying the web, winding the dried web to form a plurality of parent rolls, unwinding the parent rolls using center drive unwind means, moving the partially unwound roll to effect splicing with a subsequent parent roll, and rewinding the thus united web. In one aspect, a method of making a tissue web is disclosed for the production of a soft, high bulk uncreped throughdried tissue web by depositing an aqueous suspension of papermaking fibers onto an endless forming fabric to form a web and drying the web by throughdrying to final dryness without any significant differential compression to form a dried web having a bulk value of about 15 to 25 cubic centimeters per gram or greater, an MD Stiffness Factor of 50 to 100 kilograms, a machine direction stretch of 15 to 25 cubic percent, and a substantially uniform density.

20 Claims, 9 Drawing Sheets

MAKING A WEB

BACKGROUND OF THE INVENTION

1. Technical Field

This present invention relates to a method of making a web. More particularly, the invention pertains to a method of making a tissue web that is wound on large diameter parent rolls, unwound using a center drive unwind system, and subsequently rewound into retail sized products.

2. Background

Unwinds are used widely in the paper converting industry, particularly in the production of bathroom tissue and kitchen toweling. Manufactured parent rolls are unwound for finishing operations, such as calendering, embossing, printing ply attachment, perforating, and then rewound into retail-sized logs or rolls. At the time a parent roll runs out in a traditional operation, the spent shaft or core must be removed from the machine, and a new roll moved into position by various means such as an overhead crane or extended level rails.

INTRODUCTION TO THE INVENTION

Historically, the unwinds made use of core plugs for support on unwind stands with the power for unwinding coming from belts on the parent roll surface. In contrast, center driving has been used mainly in film unwinding.

The down time associated with parent roll change represents a substantial reduction in total available run time and manpower required to change a parent roll, and hence reduces the maximum output that can be obtained from a rewinder line.

Thus, there is a need for an improved method for making a web which improves the characteristics of the web, such as the bulk and uniformity of the web, and for making a web that dramatically reduces the time the machine is actually stopped, to significantly improve overall efficiency, and to maintain or improve safety for all personnel.

SUMMARY OF INVENTION

In one embodiment, the invention pertains to a method of making a tissue web, comprising: depositing an aqueous suspension of papermaking fibers onto an endless forming fabric to form a web; drying the web; winding the dried web to form a plurality of parent rolls each comprising a web wound on a core; transporting the parent rolls to a frame including a pair of horizontally spaced apart side frames, each side frame comprising an elongated arm mounted on and moveable relative to the side frame, each elongated arm comprising a retractable chuck means; inserting the retractable chuck means into a first parent roll core; moving the elongated arms to transport the first parent roll core to an unwind position; partially unwinding the first parent roll using variable speed drive means operably associated with the chuck means; moving the elongated arms and the partially unwound first parent roll toward a core placement table, the core placement table adapted to receive from the elongated arms the partially unwound first parent roll; rotatably supporting the partially unwound first parent roll on the core placement table; moving the elongated arms away from the core placement table; inserting the retractable chuck means into a second parent roll; bonding a leading end portion of the web on the second parent roll to a trailing end portion of the partially unwound first parent roll to form a joined web; and rewinding the joined web.

The webs of the parent rolls are united using the thread-up conveyor. The leading end portion of the web on the second parent roll is transported by the thread-up conveyor, which preferably comprises a vacuum means operably associated with an endless screen belt means. In one embodiment, the leading end portion of the web on the second parent roll is transported over the endless screen belt means with decreasing amounts of vacuum. Once the leading end portion of the web on the second parent roll is disposed on the trailing end portion of the web on the partially unwound first parent roll, the thread-up conveyor and unwinding the second parent roll are operated at a same surface speed.

Advantageously, the thread-up conveyor may be moved, and in particular pivoted, relative to the second parent roll between an active position and a standby position. In the active position, the thread-up conveyor is in close proximity to or in contact with the second parent roll, whereas in the standby position the thread-up conveyor is away from the parent roll for ease of operator access.

The core placement table is desirably moveable in a direction transverse to the path of travel of the web between an inline position and a standby position. The inline position corresponds to the web centerline to enable partially unwound parent rolls to be placed on the core placement table, whereas in the standby position the core placement table is away from the unwinding operation for ease of operator access.

Suitable soft, high bulk tissues for purposes of this invention include tissue sheets as described in U.S. Pat. No. 5,607,551 issued Mar. 4, 1997 to Farrington, Jr. et al. entitled "Soft Tissue ", which is herein incorporated by reference. The method is particularly useful for soft, high bulk uncreped throughdried tissue sheets. Such tissues can be characterized by bulk values of about 9 cubic centimeters per gram or greater (before calendering), more specifically from 10 to about 35 cubic centimeters per gram, and still more specifically from about 15 to about 25 cubic centimeters per gram. The method for measuring bulk is described in the Farrington, Jr. et al. patent. In addition, the soft, high bulk tissues of this invention can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor for tissue sheets of this invention, expressed as (kilograms per 3 inches)-microns$^{0.5}$, can be about 150 or less, more specifically about 100 or less, and still more specifically from about 50 to about 100. Furthermore, the soft, high bulk tissues of this invention can have a machine direction stretch of about 10 percent or greater, more specifically from about 10 to about 30 percent, and still more specifically from about 15 to about 25 percent. In addition, the soft, high bulk tissue sheets of this invention suitably have a substantially uniform density since they are preferably throughdried to final dryness without any significant differential compression.

Parent roll cores used in the present method preferably have an outside diameter of at least about 14 inches, more particularly about 20 inches, and the parent rolls have an outside diameter of at least about 60 inches, such as about 140 inches, and a width of at least about 55 inches, such as about 105 inches.

The center driven unwind system for the present method is used to eliminate or reduce the following detrimental effects on the web: 1. Surface damage (scuffing, tearing, etc.); 2. Wrinkling of the web; 3. De-bulking; and 4. Stretch loss. All of these detrimental effects are typical of a surface driven unwind on a low-density basesheet, such as an uncreped through-air-dried basesheet. These effects negatively impact the off-line finishing processes and/or the finished product. A large factor in creating these defects is the differential effects across the face of a parent roll due to the limited contact area with the surface driven unwind belts. Specifically the possible defects are: 1. Surface damage: Introduces defects or tears that affect product performance and/or process runability; 2. Wrinkling: Impacts processes such as calendering, embossing, printing, ply-bonding, perforating and rewinding, thereby affecting finished product appearance, performance and process runability; 3. De-bulking: Results in denser web which affects product performance and preference; 4. Stretch loss: Affects product performance and/or process runability.

The center driven unwind is used to preserve web attributes, such as high bulk and stretch, during the unwinding process. The web is also treated consistently across the face of the parent roll. Other system components, such as draw control, are used to further protect the web. The tissue product of this invention can be one-ply, two-ply, three-ply or more. The individual plies can be layered or non-layered (homogeneous) and uncreped and throughdried.

For purposes herein, "tissue sheet " is a single ply sheet suitable for facial tissue, bath tissue, towels, napkins, or the like having a density of from about 0.04 grams per cubic centimeter to about 0.3 grams per cubic centimeter and a basis weight of from about 4 to about 40 pounds per 2880 square feet. Tensile strengths in the machine direction are in the range of from about 100 to about 5,000 grams per inch of width. Tensile strengths in the cross-machine direction are in the range of from about 50 to about 2500 grams per inch of width. Cellulosic tissue sheets of paper-making fibers are preferred, although synthetic fibers can be present in significant amounts.

BRIEF DESCRIPTION OF THE DRAWINGS

The invention is described in conjunction with the accompanying drawings.

DETAILED DESCRIPTION

Figure 15:
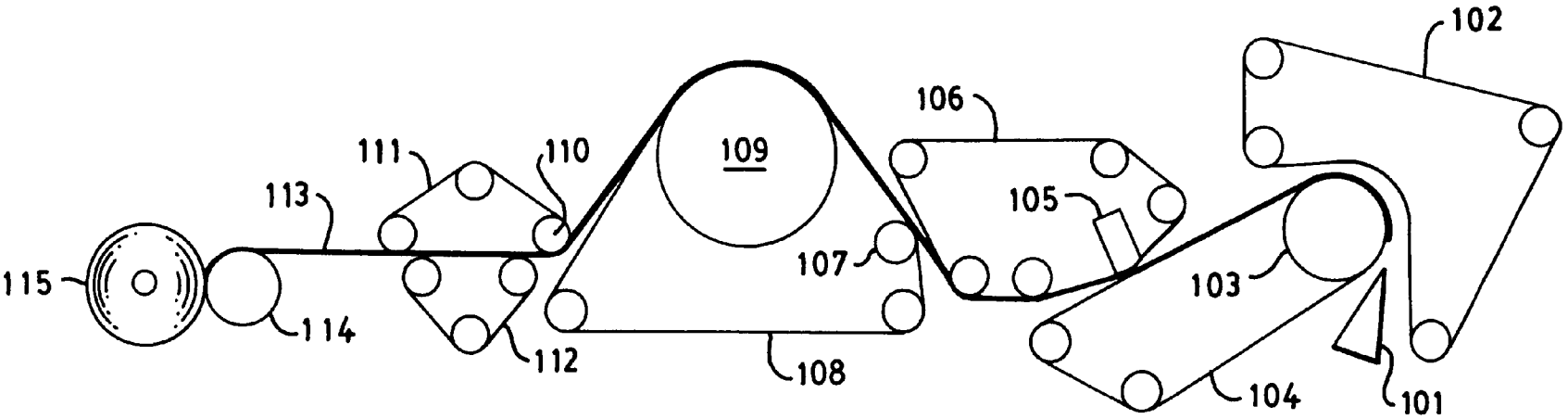
FIG. 15 is a partial schematic process flow diagram for a method of making a tissue web, and in particular an uncreped tissue web.

Referring to FIG. 15, a method of carrying out this invention will be described in greater detail. FIG. 15 describes a process for making a tissue web, and particularly an uncreped throughdried base sheet. Shown is a twin wire former having a layered papermaking headbox 101 which injects or deposits a stream of an aqueous suspension of papermaking fibers onto a forming fabric 102. The resulting web is then transferred to a fabric 104 traveling about a forming roll 103. The fabric 104 serves to support and carry the newly-formed wet web downstream in the process as the web is partially dewatered to a consistency of about 10 dry weight percent. Additional dewatering of the wet web can be carried out, such as by differential air pressure, while the wet web is supported by the forming fabric.

The wet web is then transferred from the fabric 104 to a transfer fabric 106 traveling at a slower speed than the forming fabric in order to impart increased MD stretch into the web. A kiss transfer is carried out to avoid compression of the wet web, preferably with the assistance of a vacuum shoe 105. The web is then transferred from the transfer fabric to a throughdrying fabric 108 with the aid of a vacuum transfer roll 107 or a vacuum transfer shoe. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance.

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater by a throughdryer 109 and thereafter transferred to an upper carrier fabric 111 traveling about roll 110.

The resulting dried basesheet 113 is transported between upper and lower transfer fabrics, 111 and 112 respectively, to a reel 114 where it is wound into a parent roll 115 for subsequent unwinding, possible converting operations, and rewinding as described below.

Figure 1:
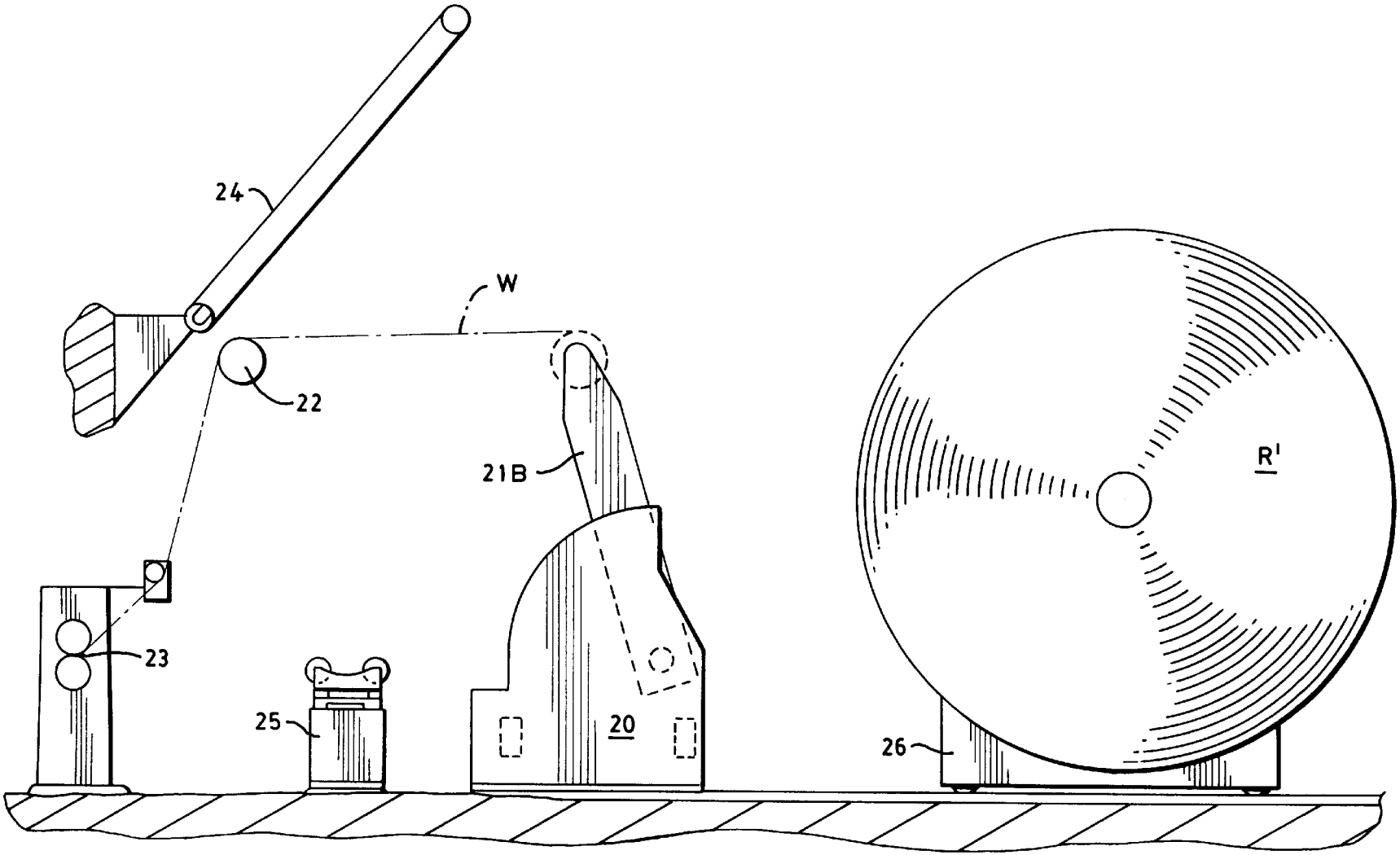
FIG. 1 is a schematic side elevational view of the inventive unwind system near the end of an unwind cycle.
Figure 2:
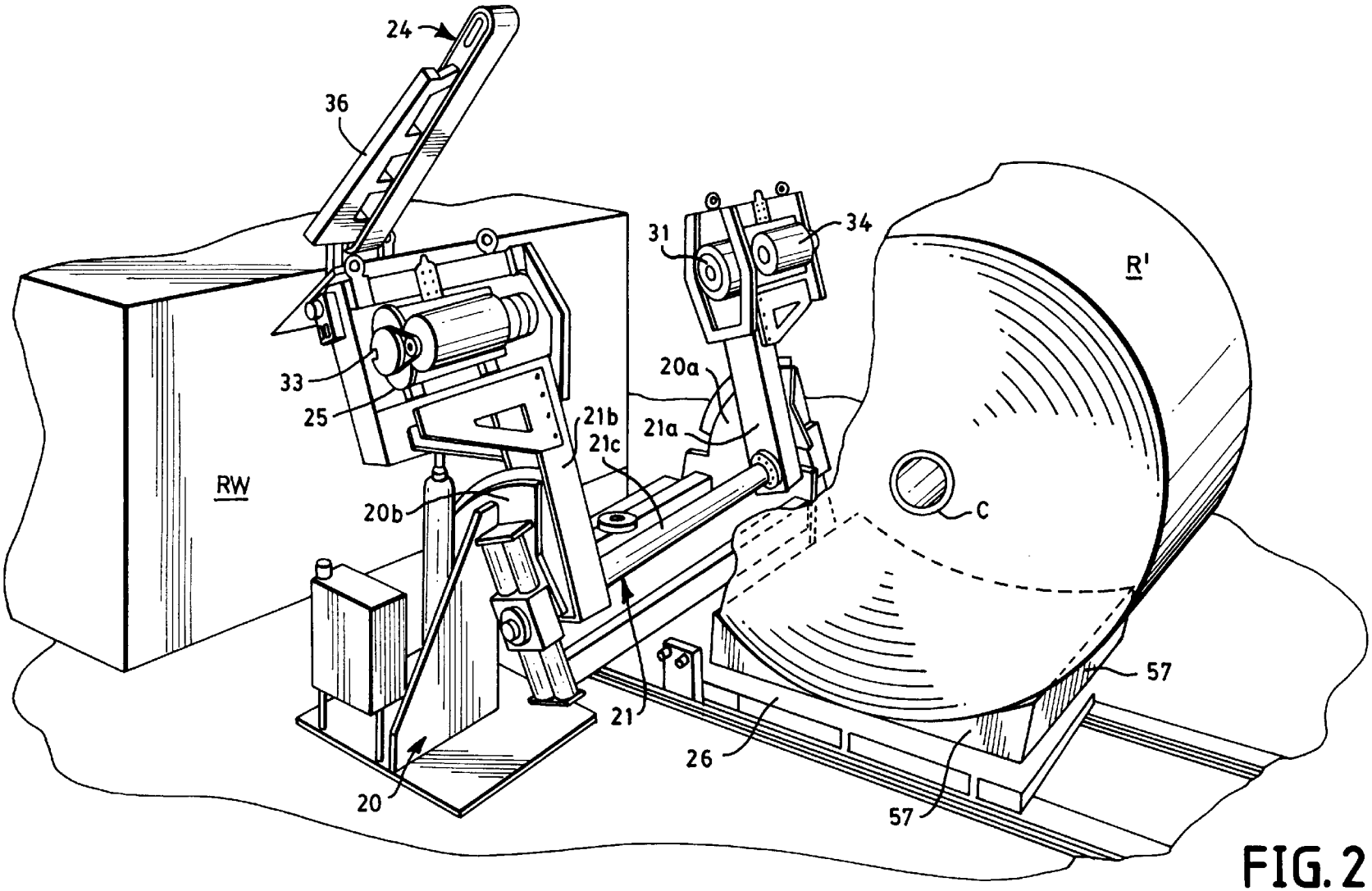
FIG. 2 is a perspective side elevational view of the unwind system of FIG. 1 in the form of a commercial prototype as seen from the upstream drive side, i.e., the side opposite the operator side—upstream referring to the start of the path or stream of the web and downstream being toward the rewinder.
Figure 3:
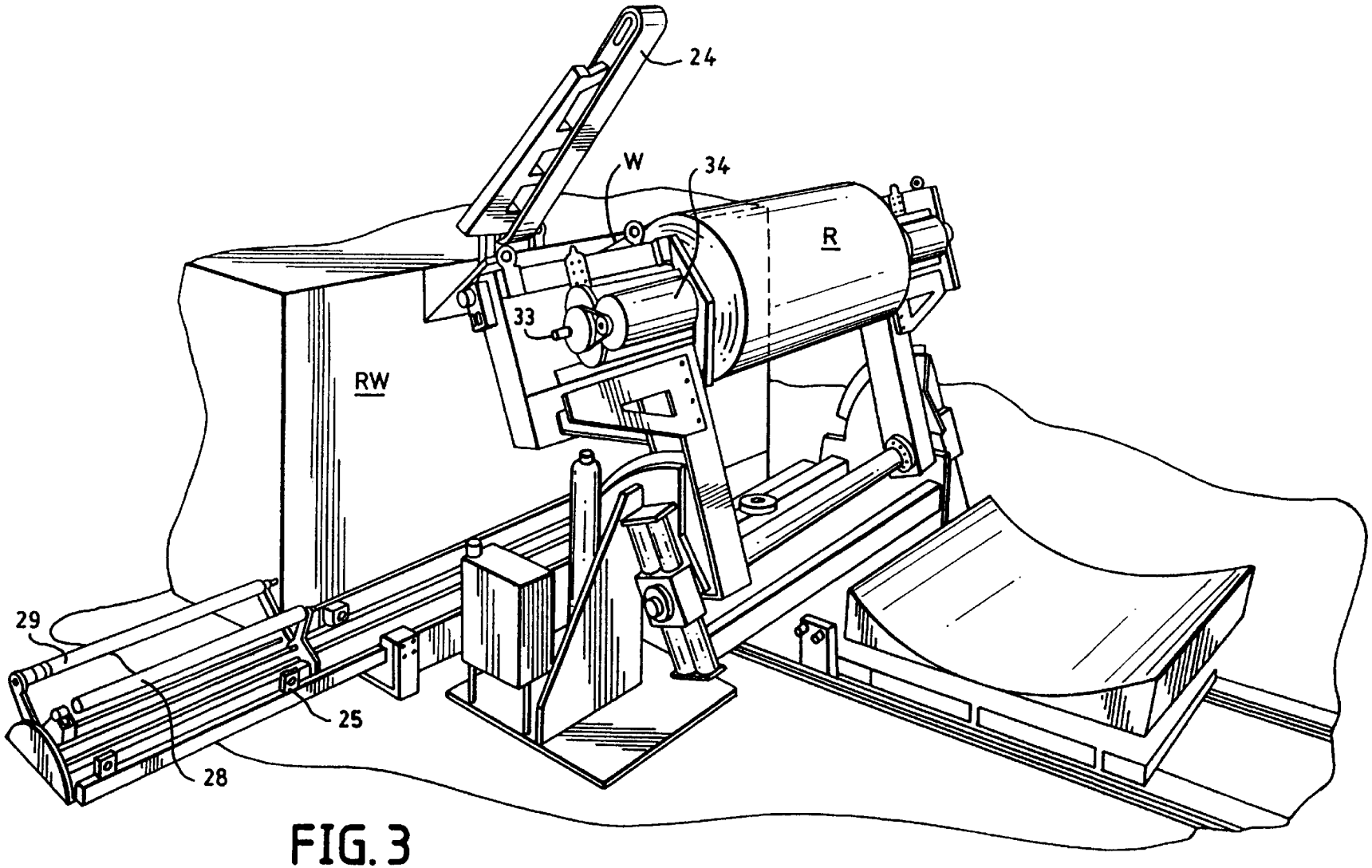
FIG. 3 is another perspective view of the unwind system but slightly more downstream than FIG. 2 and showing the unwind in the middle of an unwind cycle.
Figure 4:
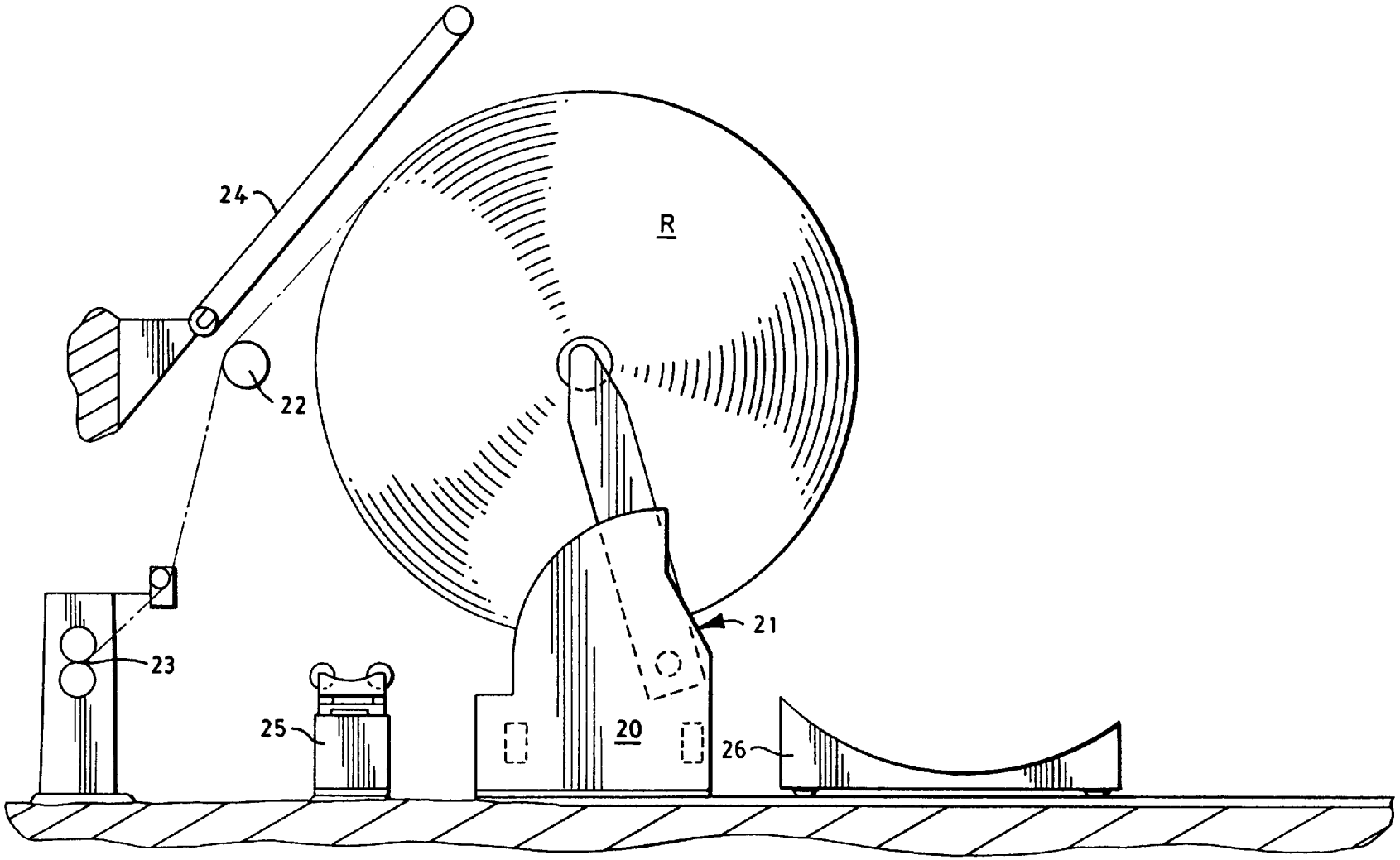
FIG. 4 is a schematic side elevational view corresponding to the perspective view of FIG. 3 but showing a full roll at the start of the unwinding cycle.
Figure 5:
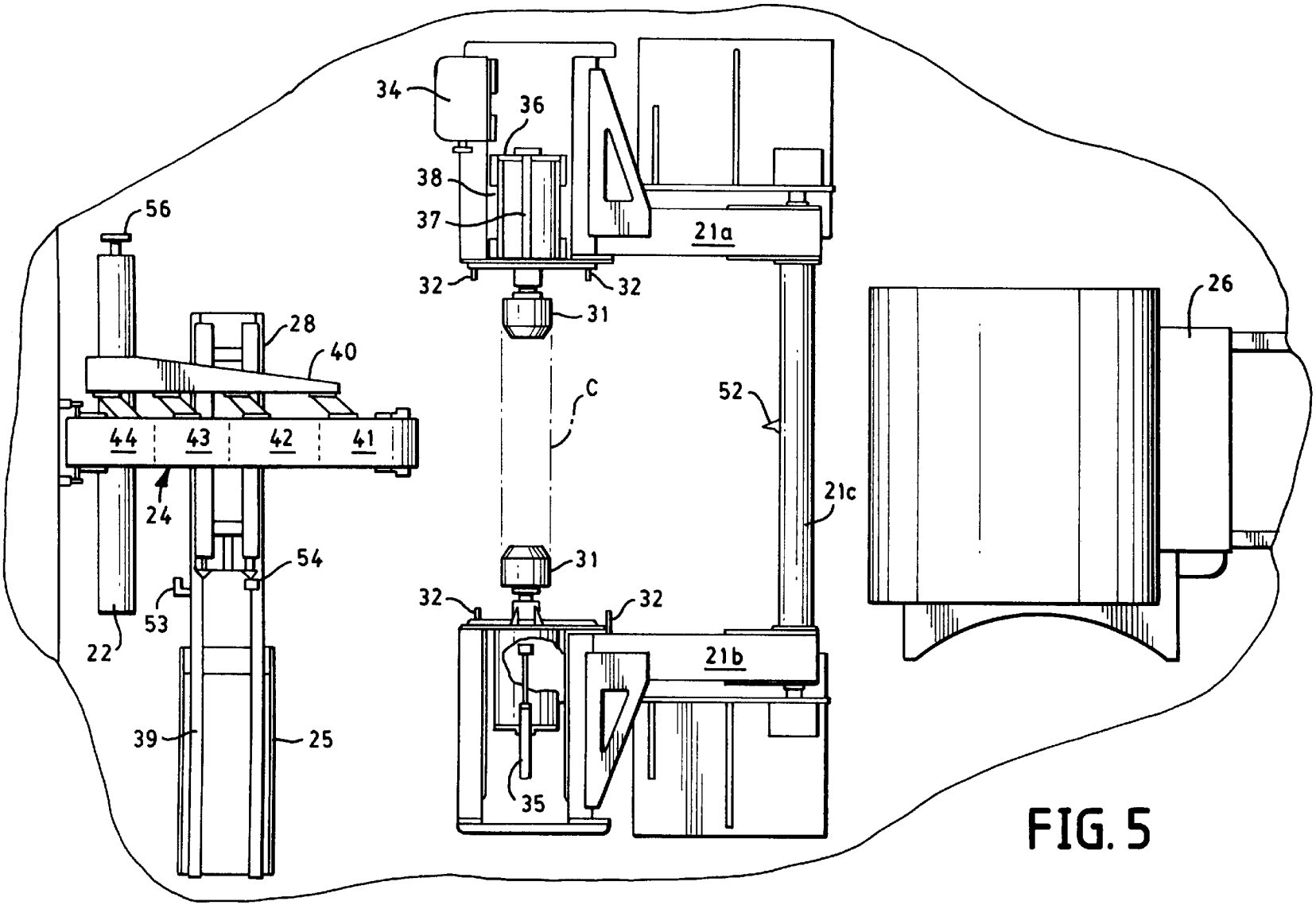
FIG. 5 is a top plan view of the unwind system as seen in the preceding views but with a portion broken away to reveal an otherwise hidden cylinder.

In the central part of FIGS. 1 and 2, the numeral 20 designates generally a frame for the unwind stand which includes a pair of side frames as at 20*a* and 20*b*—the latter being seen in the central portion of FIG. 2. The frame 20 pivotally supports arm means generally designated 21 which is seen to be essentially U-shaped. The arm on the operating side is designated 21*a* while the arm on the drive side is designated 21*b*. Interconnecting and rigidifying the two arms is a transverse member 21*c*. The arms are seen to support a parent roll R which, as can be quickly appreciated from a consideration of FIGS. 3 and 4, is in the process of being unwound to provide a web w. The web W proceeds over a roller 22 (designated in the center left of FIG. 4) and into a bonding unit generally designated 23. These elements of the system are also seen in FIG. 5. The roller 22 may be an idler or driven.

Other elements depicted in FIGS. 1–4 are a thread-up conveyor generally designated 24, a core placement table generally designated 25 and a means 26 such as a cart for supporting a parent roll R' subsequently to be unwound—see FIGS. 1 and 2. In FIG. 2, the core C is clearly seen. Also, at the extreme left in FIGS. 2 and 3, a rewinder RW is seen to be at the downstream end of the system.

It is believed that the invention can be appreciated most quickly from an understanding of the sequence of operation which is depicted in FIGS. 1 and 6–11.

Figure 14:
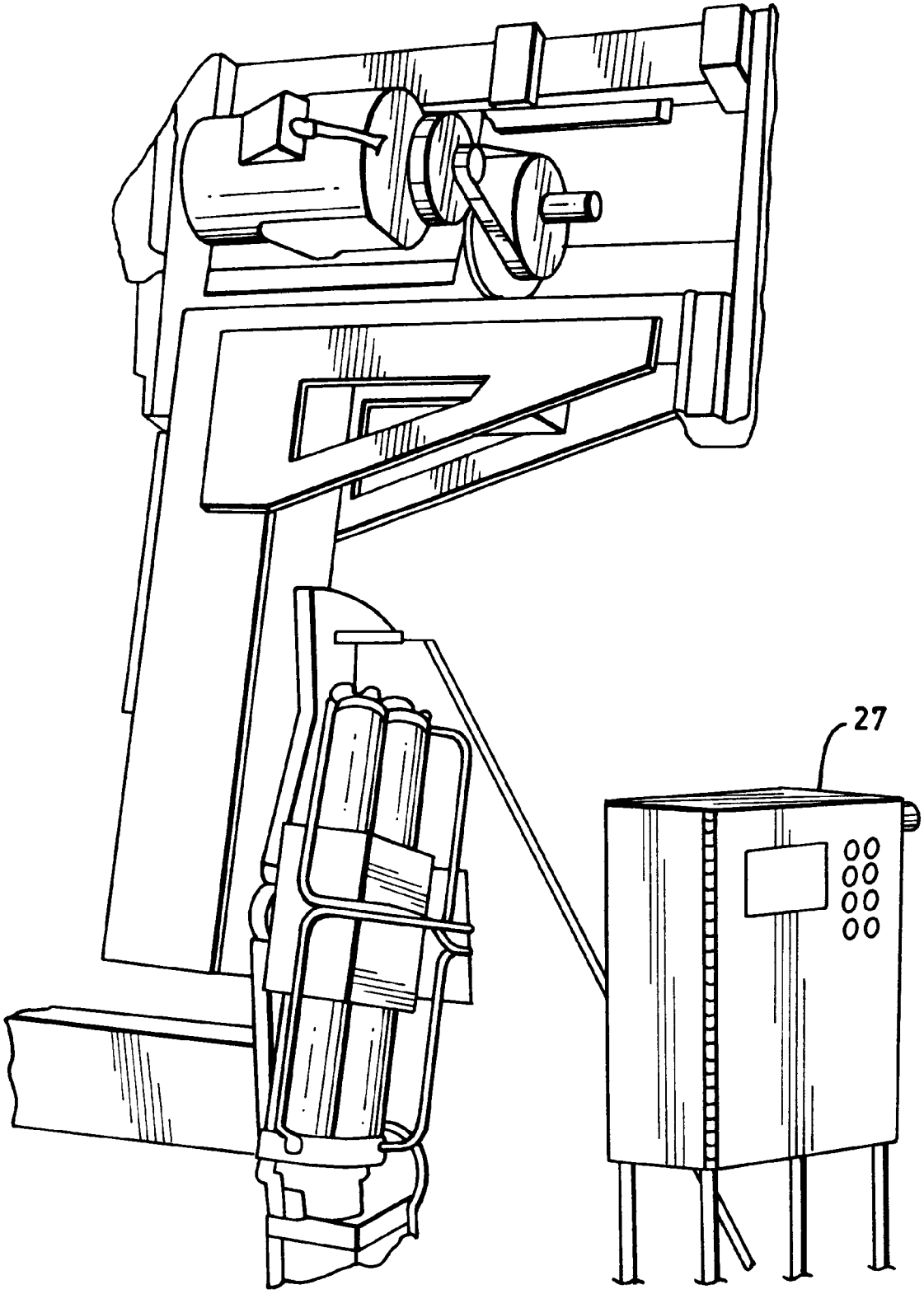
FIG. 14 is a fragmentary perspective view from the operator side of the unwind system and featuring the control means.

With the machine running and the diameter of the parent roll R decreasing, a deceleration diameter is calculated by a control means generally designated 27. In FIG. 2, this is partially obscured by the side frame 20*a* but can be seen clearly in FIG. 14.

When the parent roll diameter reaches this determined diameter, the unwind and associated equipment begin decelerating. During this time the core placement table 25 is aligned with the web center line of FIG. 2—having been in the standby position of FIG. 3.

When all machine sections reach zero or a reduced speed and the core table 25 is confirmed empty, the core placement position of the arm means 21 is calculated which will set the expired parent roll $R_x$ slightly above or lightly on the cradle rollers 28, 29 of the core table 25. Advantageously, one of the cradle rollers—as at 28—is driven, while the other is an idler.

Figure 6:
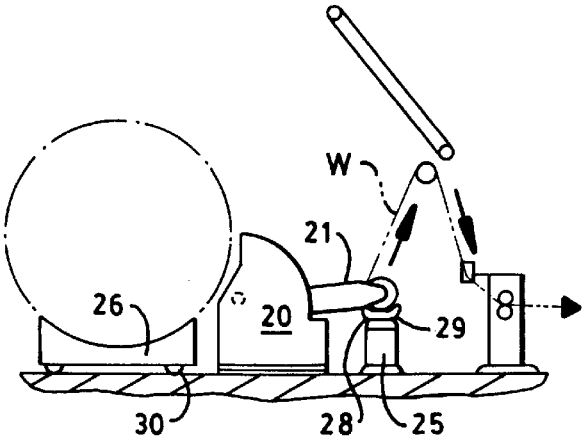
FIG. 6 is a schematic side elevational view similar to FIG. 1 but from the operator side and also showing the condition of the apparatus as a parent roll is almost completely unwound, i.e., slightly later in the operational sequence than FIG. 1.
Figure 7:
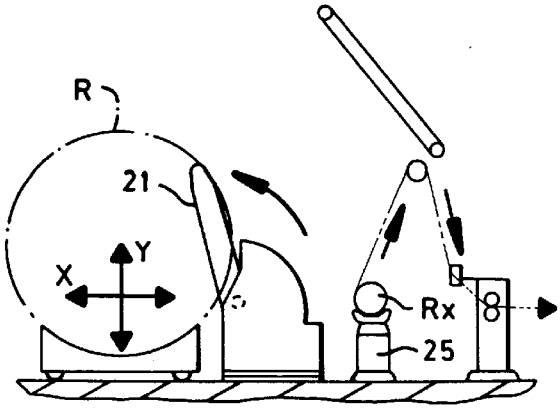
FIG. 7 is another sequence view now showing the beginning of the provision of a new parent roll.

The arm means 21 is now pivoted toward this calculated position—as shown in FIG. 6. As the arm means moves under the signal from the control means 27, the web W can be unwound in order to prevent web breakage. During this period the parent roll cart 26 (see FIG. 6) is moved into the unwind loading position.

The cart movement is based on previous roll diameter, measured diameter or an assumed diameter. The previous roll diameter is that of the last parent roll when loaded. So the assumption is that the new parent roll has the same diameter and so the position of the "old" roll is the one selected for the "new" roll. The "measured" diameter can be that as actually measured, either mechanically or manually. The "assumed" diameter is a constant value selected by the operator which is used repeatedly as coming near the actual diameter. In any event, this pre-positions the cart to minimize subsequent moves which, if needed, could frustrate the achievement of a one-minute or less roll change. The cart movement is under the control of the control means 27. The object of the inventive unwind is to have its operation as automatic as possible—for both safety and efficiency.

The cart 26 may move into the position shown in the unwind along either the machine directional axis or the cross directional axis. However, the cart 26 is shown moving along the machine direction (see the wheels 30) in FIGS. 6–13 for conceptual clarity.

When the arm means 21 reaches the core drop position relative to the core table 25 as shown in FIG. 6, the core chucks 31 (see FIG. 5) are contracted by control means 27 which allows both of the core chucks 31 (see particularly FIG. 2) to be fully retracted out of the core C (compare FIGS. 6 and 7), and the expired parent roll $R_x$ placed onto the core table 25 Advantageously, the control means 27 is a Model PIC 900 available from Giddings and Lewis, located in Fond du Lac, Wis.

As the arm means 21 moves toward this new position, photoelectric sensors 32 (see FIG. 5) which are mounted on the arm means 21, detect the edge of the parent roll loaded into the parent roll cart. When each sensor detects a parent roll edge, the angular position of the arm means 21 is recorded by the control means 27. Each data point along with known geometries and cart X-Y coordinates (see the designated arrows in FIG. 7) is used to calculate parent roll diameter and estimate X-Y coordinates of the center of the core C. Based on the core coordinates, the parent roll cart 26 is repositioned.

With the parent roll R repositioned and arm means 21 moving toward the parent roll loading position, the sensors 32 mounted on the arm means 21—see FIG. 5—will detect the leading and trailing edge of the core. As each sensor 32 detects an edge, the angular position of the associated pivot arm is recorded in the control means 27.

This data, along with known geometries, is used to calculate multiple X-Y coordinates of the center of the core. Coordinates are calculated separately for each end of the core. Averaging is used to obtain a best estimate of core coordinates for each end of the core.

The parent roll cart 26 is again repositioned to align the center of the core C and core chucks 31. If the cross directional axis of the core is properly aligned with the cross directional axis of the cart 26, both the core chucks 31 are extended into the core C and the chucks are expanded to contact the core. The expansion and contraction of the chuck means 31 is achieved by internal air operated bladders or other actuating means under signal from the control means 27. Air is delivered through a rotary union 33—see the central portion of FIG. 3.

Figure 8:
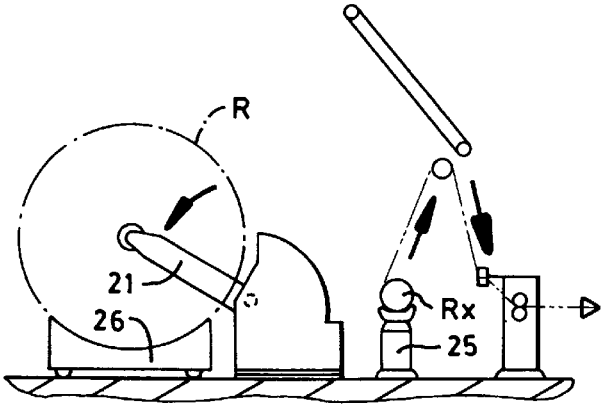
FIG. 8 is a view of the apparatus in its condition slightly later than that shown in FIG. 7.

FIG. 8 shows the arm means 21 in the loading position. If core skewing is excessive, the alignment of the parent roll core and core chucks must be individually performed on each end of the core. First, the arm means 21 and possibly the parent roll cart 26 are positioned so that one chuck 31 can be extended into the core C. Once in the core, the first chuck is expanded. Next, the parent roll cart 26 and/or arm means 21 is repositioned to align the remaining core chuck 31 with the core C. Once aligned, the second core chuck 31 is extended and expanded.

When fully chucked, regardless of the chucking process, the parent roll R is lifted slightly out of the cart 26. Then, the parent roll is driven, i.e., rotatably, by motors 34 which drive the chucks 31. Using motors on each arm evenly distributes the energy required. However, advantageous results can be obtained with motorizing only one of the chucks. Sufficient torque is applied by the core chuck drive motors 34 to test for slippage between a core chuck 31 and the core C. If slippage is detected, the parent roll is lowered back into the cart 26. The core chucks are contracted, removed from the core, and repositioned (i.e., "loaded") into the core. The core slippage test is then repeated. Multiple failures of this test can result in an operator fault being issued.

Figure 9:
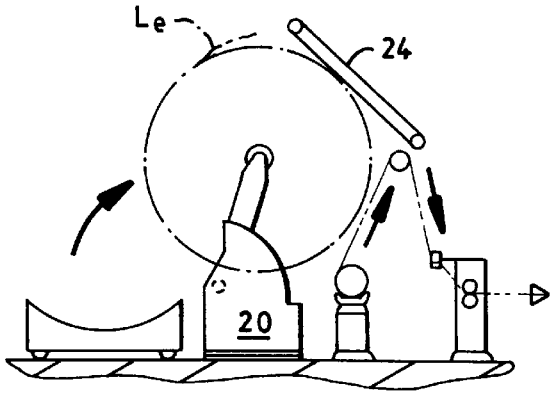
FIG. 9 is a view like the preceding views except that now a fully wound parent roll is installed in the unwind.

If no slippage is detected, arm means 21 is moved to the winding position, i.e., generally upright. As shown by FIG. 9, with the arm means in the run position, the vacuum thread up conveyor 24 is lowered onto parent roll and the vacuum is activated. The core chuck drive motors 34 rotate the parent roll R. The thread-up conveyor 24 operates at the same surface speed as the parent roll surface speed.

Figure 10:
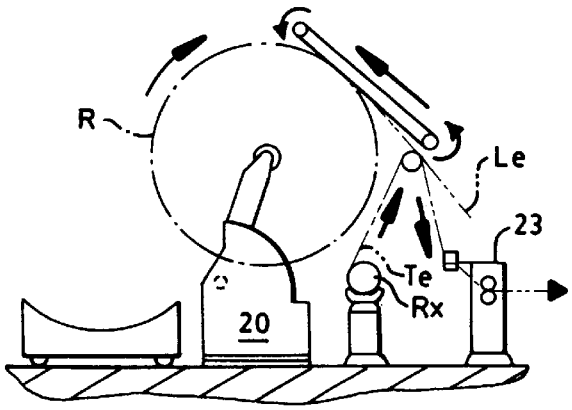
FIG. 10 is a view of the apparatus in a condition for coupling the leading edge portion of the new parent roll to the trailing tail portion of the almost expended parent roll.
Figure 11:
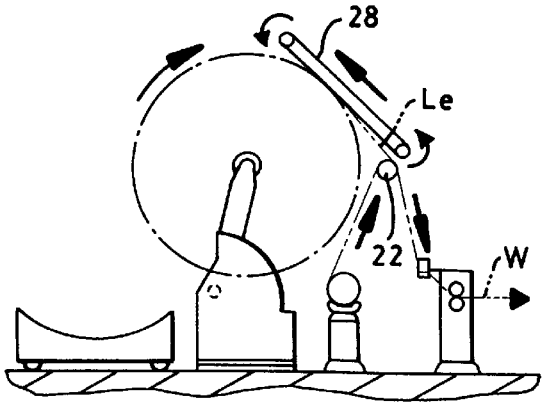
FIG. 11 is a view similar to FIG. 10 but now showing the two webs in the process of being bonded together.

Now referring to FIG. 10, when the leading end $L_e$ comes into contact with the vacuum conveyor 24, the tail is sucked up and pulled along by the vacuum thread up conveyor.

When the discharge end of the vacuum thread-up conveyor 24 is reached, the new web end portion $L_e$ drops onto the trailing end portion $T_e$ of the web from the expired parent roll $R_x$, depicted by FIG. 10. The rest of the machine line including the driven roller 28 is now brought up to match speed with that of the unwind.

The new web is carried through the line with the web from the expired roll. The two webs can then be bonded together as at W in FIG. 11. An embossing-type method as at 23 is shown, but any method of web bonding could be used. After combining the webs, the web from the expired parent roll is no longer needed and brake means associated with the core table or roller 28 stops the expiring parent roll from turning and thus breaks the expired web. When appropriate, vacuum is removed and the vacuum thread-up conveyor is raised. The unwind now returns to previous running speeds. As the machine accelerates, the parent roll cart 26 is returned to its loading position for another roll and the core table is retracted to allow for core removal.

The control means 27 performs a number of functions. First, in combination with the parent roll cart means 26, it calculates diameter and determines the position of the core C for positioning the cart means for insertion of the chuck means 31 into the parent roll core. Further, the control means 27 includes means cooperating with the sensor means 32 for calculating the coordinates of the parent roll core and averaging the coordinates prior to insertion of the chuck means 31. Still further, the control means includes further means for comparing the alignment of the core cross-directional axis with the parent roll cross-directional axis.

When all is aligned, the control means 27 operate the chuck means 31 for insertion into the core C by actuation of the cylinders 35 (see FIGS. 2 and 5). The control means 27 further causes expansion of the chuck means 31 in order to internally clamp the tubular core C. Relative to the insertion of the chuck means 31, the drive shaft of each motor 34 is offset from the axis of the associated chuck means 31 as can be seen in the left central part of FIG. 2 and the upper part of FIG. 5. There, the motor 34 is connected by a drive 36 to the shaft 37 of the chuck means 31. The shaft 37 is rotatably supported in the housing 38 of the chuck means 31. From the upper part of FIG. 5, it will be seen that the motor 34 is offset from the shaft 37 and from the lower part of FIG. 5 it will be seen that the cylinder 35 is responsible for moving the housing 38 and therefore the chuck means 31 into engagement with the core C.

During normal operation, the control means also calculates the deceleration diameter of the roll R being unwound, confirms the emptiness of the core table 25 and operates the arm means 21.

Reference to FIG. 5 reveals that the core placement table 25 is mounted in rails 39 for advantageous removal during the unwind cycle. So if a web break occurs, the table is out of the web path so as not to interfere with clean-up. Also in FIG. 5 the thread-up conveyor 24 is seen to include a vacuum manifold 40 which provides a plurality of vacuum stages as at 41, 42, 43 and 44 of gradually less vacuum. The conveyor 24 is advantageously of screen or mesh construction to facilitate pickup of the leading edge portion of the web from the "new " parent roll.

Such a leading end portion may be folded to provide triangular shape to facilitate taping down. This helps prevent inadvertent detachment of the leading edge portion from the underlying ply during transfer of the parent roll from the paper machine to the site of rewinding. Normally, the first log rewound from a new parent roll is discarded so this eliminates the concern over a lumpy transfer.

As part of the program of operation of the unwind under the control of the control means 27, the conveyor 24 and vacuum from a pump (not shown) are both shut down to conserve energy and avoid unnecessary noise.

Figure 12:
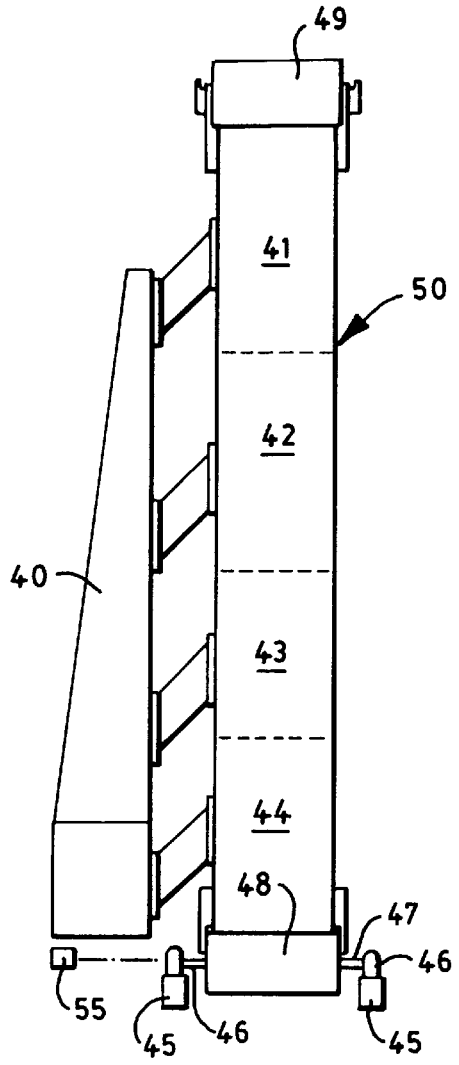
FIG. 12 is a top plan view of the thread-up conveyor.
Figure 13:
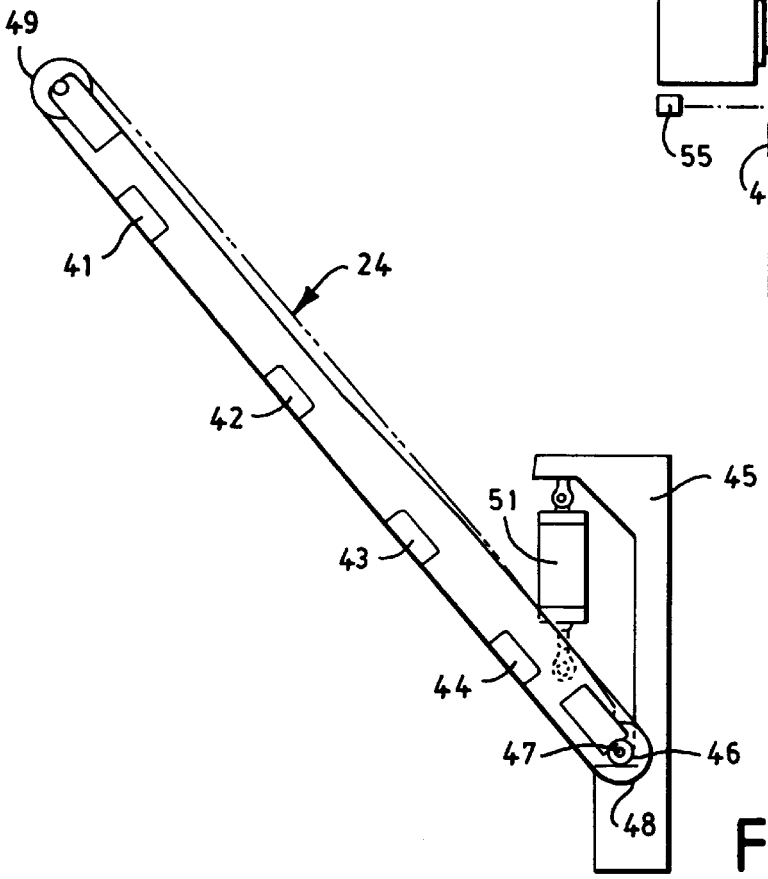
FIG. 13 is a side elevational view of the conveyor of FIG. 12.

The thread-up conveyor 24 is pivotally supported on a pair of pedestals 45 (see the right lower portion of FIG. 13) which provides a mounting 46 for each side of the conveyor 24—see FIG. 12. The mountings 46 rotatably carry a cross shaft 47 which is on the axis of the lower (driving) roller 48. At its upper end, the conveyor has an idler roller 49 supported on the staged chamber generally designated 50 which is coupled to the manifold 40.

Positioning of the conveyor 24 via changing its angle is achieved by a pair of pressure cylinders 51 coupled between the pedestals 45 and the chamber 50. The cylinders 51 are also under the control of the control means 27.

To enable the control means 27 to calculate the deceleration diameter near the end of the unwind cycle, a further sensor 52 is provided—this on the transverse member 21*c* of arm means 21, as seen in FIG. 5. In addition, the sensor continually reports the radius of the parent roll and the control means continually calculates the motor speed to obtain a desired unwind. Alternatively, process feedback such as load cells or dancers can be used to report to the control means changes in tension or the like and enable the control means to vary the motor speed.

Once the rewinder is located—a primary consideration because of its involvement with the core hopper, core feed, log removal and log saw, the unwind frame 20 is placed a suitable distance upstream to accommodate the core placement table 25, the thread-up conveyor 24 and any bonding unit 23.

The location of the core placement table 25 is a function of the pivot geometry of the arm means 21 as can be appreciated from a consideration of FIG. 6. On the other hand, the location of the thread-up conveyor 24 is not only a function of the arm means geometry but also the size parent rolls to be unwound.

In a similar fashion to the location of the core table 25, the cart 26 must be placeable to have the parent roll engageable by the chucks 31 of the arm means 21.

The unwind system, although having a means for actually rotating the parent roll, really includes a path or section of a mill's converting area extending from the cart means 26 which provides the next parent roll, all the way to the rewinder proper.

The inventive system includes many novel features which are discussed below. For example, the invention contemplates the use of roll cart means 26 operably associated with the frame 20 for supporting a "new" parent roll R', the means 26 cooperating with the control means 27 also operably associated with the frame 20 for positioning chuck means 31 for inserting the same into a parent roll core C.

Further, the control means 27 includes sensor means 32 cooperatively coupled together for calculating the coordinates of the "new" parent roll R' and averaging the coordinates prior to insertion of the chuck means 31.

Still further, the control means 27 includes the capability to compare the alignment of the core cross directional with the parent roll cross directional axis. The control means capability also includes the controlling of the insertion of the chuck means 31 into the core C—as by, for example, controlling the operation of the fluid pressure cylinders 35.

Near the end of the unwinding cycle, the control means 27 regulate the pivotal movement of the arm means 21 as a function of the degree of unwinding of the parent roll R. Also during the unwinding cycle (during its last stages generally), the control means 27 in combination with sensing means 53 determines the condition of the core placement table 25—see the left center portion of FIG. 5.

Near the very end of the unwinding cycle it is important for the core placement table to be in position to receive the almost-expired roll $R_x$, be free of any obstructing material and also have its rotating roller 28 in operation. But at the very end, motor and brake means 54 operably associated with the roller 28 are energized to snap off the web W—and with a minimum of web tail retained on the table 25—optimally about ¼" (6 mm).

Prior to the time referred to immediately above, but again toward the end of an unwinding cycle, the control means actuates the thread-up conveyor 24 via a drive 55—see the lower left of FIG. 12. The drive 55 is coupled to the drive 56 of the driven roller 22 (see FIG. 5) which, in time, is driven by a motor (not shown). Also, there is actuation of a vacuum pump (not shown) to apply a reduced pressure to the manifold 40.

As indicated above, the disclosed method and unwind system for large diameter parent rolls is completely automated to avoid the need for manual handling of cumbersome and potentially dangerous rolls. At the outset, the cart 26 is advantageously equipped with an upper table 57 (see FIG. 2) which is rotatable about a vertical axis through an arc of 90° to permit cantilever delivery of a new parent roll whose axis is parallel to the length of the web path, i.e., from cart 26 to bonding station 23. The controller 27 thereupon causes the table 57 to rotate to the FIGS. 2 and 3 showings for commencing the unwind cycle. As the previous parent roll nears expiration, the arm means 21—which have been detached from the previous roll core are automatically pivoted from downstream to upstream and the chucking of the core performed automatically as described above. Then, at the end of the cycle, the depleted core is deposited on the table 25 and the arm means 21 unchucked for the initiation of another cycle.

While in the foregoing specification, a detailed description of an embodiment of the invention has been set down for the purpose of illustration, many variations in the details hereingiven may be made by those skilled in the art without departing from the spirit and scope of the invention.

We claim:

1. A method of making a soft, high bulk uncreped throughdried tissue web, comprising:

depositing an aqueous suspension of papermaking fibers onto an endless forming fabric to form a web;

drying the web to form a dried web having a bulk value of about 9 cubic centimeters per gram or greater;

winding the dried web to form a plurality of parent rolls each comprising a web wound on a core;

transporting the parent rolls to a frame including a pair of horizontally spaced apart side frames, each side frame comprising an elongated arm mounted on and moveable relative to the side frame, each elongated arm comprising a retractable chuck means;

inserting the retractable chuck means into a first parent roll core;

moving the elongated arms to transport the first parent roll core to an unwind position;

partially unwinding the first parent roll using variable speed drive means operably associated with the chuck means; moving the elongated arms and the partially unwound first parent roll toward a core placement table, the core placement table adapted to receive from the elongated arms the partially unwound first parent roll;

rotatably supporting the partially unwound first parent roll on the core placement table;

moving the elongated arms away from the core placement table;

inserting the retractable chuck means into a second parent roll;

joining a leading end portion of the web on the second parent roll to a trailing end portion of the partially unwound first parent roll by embossing to form a joined web without glue;

breaking the trailing end portion of the first parent roll by operating brake means associated with the core placement table to stop the expiring parent roll from turning, thereby breaking the expired web; and rewinding the joined web.

2. The method of claim 1, further comprising transporting the leading end portion of the web on the second parent roll with a thread-up conveyor means.

3. The method of claim 2, further comprising transporting the leading end portion of the web with vacuum means operably associated with an endless screen belt means.

4. The method of claim 3, further comprising transporting the leading end portion of the web on the second parent roll with decreasing amounts of vacuum as the web is transported over the endless screen belt means.

5. The method of claim 1, further comprising moving the thread-up conveyor means relative to the second parent roll between an active position and a standby position.

6. The method of claim 1, further comprising routing the web of the first parent roll over a roller and then to a bonding unit.

7. The method of claim 1, further comprising moving the core placement table transversely of a path of travel of the web between an inline position and a standby position, where the inline position corresponds to the web centerline.

8. The method of claim 1, further comprising moving the thread-up conveyor into close proximity or contact with the second parent roll.

9. The method of claim 1, further comprising operating the thread-up conveyor and unwinding the second parent roll at a same surface speed.

10. The method of claim 1, further comprising discharging the leading end portion of the web of the second parent roll onto the web from the partially unwound first parent roll.

11. The method of claim 10, further comprising unwinding the partially unwound first parent roll and the second parent roll at the same surface speed.

12. The method of claim 1, further comprising moving the thread-up conveyor and the core table to standby positions while the parent rolls are being unwound.

13. The method of claim 1, wherein the parent roll cores have an outside diameter of at least about 14 inches and the parent rolls have an outside diameter of at least about 60 inches and a width of at least about 55 inches.

14. The method of claim 1, wherein the dried web has a bulk value in the range of about 10 to 35 cubic centimeters per gram.

15. The method of claim 1, wherein the dried web has a bulk value of from about 10 to about 35 cubic centimeters per gram or greater.

16. A method of making a soft, high bulk uncreped throughdried tissue web, comprising:

depositing an aqueous suspension of papermaking fibers onto an endless forming fabric to form a web;

drying the web to form a dried web having a bulk value of about 9 cubic centimeters per gram or greater, an MD Stiffness Factor of 150 kilograms or less, and a machine direction stretch of 10 percent or greater;

winding the dried web to form a plurality of parent rolls each comprising a web wound on a core;

transporting the parent rolls to a frame including a pair of horizontally spaced apart side frames, each side frame comprising an elongated arm mounted on and moveable relative to the side frame, each elongated arm comprising a retractable chuck means;

inserting the retractable chuck means into a first parent roll core;

moving the elongated arms to transport the first parent roll core to an unwind position;

partially unwinding the first parent roll using variable speed drive means operably associated with the chuck means; moving the elongated arms and the partially unwound first parent roll toward a core placement table, the core placement table adapted to receive from the elongated arms the partially unwound first parent roll;

rotatably supporting the partially unwound first parent roll on the core placement table;

moving the elongated arms away from the core placement table;

inserting the retractable chuck means into a second parent roll;

joining a leading end portion of the web on the second parent roll to a trailing end portion of the partially unwound first parent roll by embossing to form a joined web without glue;

breaking the trailing end portion of the first parent roll by operating brake means associated with the core placement table to stop the expiring parent roll from turning, thereby breaking the expired web; and rewinding the joined web.

17. A method of making a soft, high bulk uncreped throughdried tissue web as set forth in claim 16, wherein said depositing an aqueous suspension of papermaking fibers onto an endless forming fabric to form a web and drying the web comprises depositing an aqueous suspension of papermaking fibers onto an endless forming fabric to form a web and drying the web to form a dried web having a bulk value of about 10 to 35 cubic centimeters per gram or greater, an MD Stiffness Factor of 100 kilograms or less, and a machine direction stretch of 10 to 30 percent.

18. A method of making a soft, high bulk uncreped throughdried tissue web as set forth in claim 17, wherein said depositing an aqueous suspension of papermaking fibers onto an endless forming fabric to form a web and drying the web comprises depositing an aqueous suspension of papermaking fibers onto an endless forming fabric to form a web and drying the web to form a dried web having a bulk value of about 15 to 25 cubic centimeters per gram or greater, an MD Stiffness Factor of 50 to 100 kilograms, and a machine direction stretch of 15 to 25 percent.

19. A method of making a soft, high bulk uncreped throughdried tissue web as set forth in claim 18, wherein said depositing an aqueous suspension of papermaking fibers onto an endless forming fabric to form a web and drying the web comprises depositing an aqueous suspension of papermaking fibers onto an endless forming fabric to form a web and drying the web to form a dried web having a bulk value of about 15 to 25 cubic centimeters per gram or greater, an MD Stiffness Factor of 50 to 100 kilograms, a machine direction stretch of 15 to 25 percent, and a substantially uniform density by throughdrying to final dryness without any significant differential compression.

20. A method of making a soft, high bulk uncreped throughdried tissue web, comprising:

depositing an aqueous suspension of papermaking fibers onto an endless forming fabric to form a web;

drying the web by throughdrying to final dryness without any significant differential compression to form a dried web having a bulk value of about 15 to 25 cubic centimeters per gram or greater, an MD Stiffness Factor of 50 to 100 kilograms, a machine direction stretch of 15 to 25 percent, and a substantially uniform density;

winding the dried web to form a plurality of parent rolls each comprising a web wound on a core;

transporting the parent rolls to a frame including a pair of horizontally spaced apart side frames, each side frame comprising an elongated arm mounted on and moveable relative to the side frame, each elongated arm comprising a retractable chuck means;

inserting the retractable chuck means into a first parent roll core;

moving the elongated arms to transport the first parent roll core to an unwind position;

partially unwinding the first parent roll using variable speed drive means operably associated with the chuck means; moving the elongated arms and the partially unwound first parent roll toward a core placement table, the core placement table adapted to receive from the elongated arms the partially unwound first parent roll;

rotatably supporting the partially unwound first parent roll on the core placement table;

moving the elongated arms away from the core placement table;

inserting the retractable chuck means into a second parent roll;

joining a leading end portion of the web on the second parent roll to a trailing end portion of the partially unwound first parent roll by embossing to form a joined web without glue;

breaking the trailing end portion of the first parent roll by operating brake means associated with the core placement table to stop the expiring parent roll from turning, thereby breaking the expired web;

rewinding the joined web;

transporting the leading end portion of the web on the second parent roll with a thread-up conveyor means and vacuum means operably associated with an endless screen belt means with decreasing amounts of vacuum as the web is transported over the endless screen belt means;

moving the thread-up conveyor means relative to the second parent roll between an active position and a standby;

routing the web of the first parent roll over a roller and then to a joining unit;

moving the core placement table transversely of a path of travel of the web between an inline position and a standby position, where the inline position corresponds to the web centerline;

moving the thread-up conveyor into close proximity or contact with the second parent roll;

operating the thread-up conveyor and unwinding the second parent roll at a same surface speed;

discharging the leading end portion of the web of the second parent roll onto the web from the partially unwound first parent roll;

unwinding the partially unwound first parent roll and the second parent roll at the same surface speed; and moving the thread-up conveyor and the core table to standby positions while the parent rolls are being unwound;

wherein the parent roll cores have an outside diameter of at least about 14 inches and the parent rolls have an outside diameter of at least about 60 inches and a width of at least about 55 inches.

* * * * *